US006253881B1

(12) United States Patent
Andersson

(10) Patent No.: US 6,253,881 B1
(45) Date of Patent: Jul. 3, 2001

(54) ADJUSTMENT DEVICE

(76) Inventor: Leif Andersson, 568 00, Skillingaryd (SE)

( * ) Notice: Subject to any disclaimer, the term of this patent is extended or adjusted under 35 U.S.C. 154(b) by 0 days.

(21) Appl. No.: 09/334,872

(22) Filed: Jun. 17, 1999

(51) Int. Cl.[7] ..... B65H 59/10
(52) U.S. Cl. ..... 188/67; 188/300; 188/77 W
(58) Field of Search ..... 188/67, 109, 300, 188/77 W; 292/275; 267/178, 131; 297/374, 362.12; 24/22, 26, 282, 460, 461, 462; 403/314

(56) References Cited

U.S. PATENT DOCUMENTS

| | | | | |
|---|---|---|---|---|
| 110,590 | * | 12/1870 | Reinshagen | 403/314 |
| 120,372 | * | 10/1871 | Eisele | 188/67 |
| 512,275 | * | 1/1894 | Burgess | 188/67 |
| 2,595,213 | * | 4/1952 | Raynor | 74/126 |
| 2,679,285 | | 5/1954 | Luckhardt . | |
| 3,230,595 | * | 1/1966 | Kedem | 188/67 |
| 3,947,069 | | 3/1976 | Lusch . | |
| 5,472,261 | | 12/1995 | Oplenskdal et al. | 297/342 |

FOREIGN PATENT DOCUMENTS

| | | |
|---|---|---|
| 721082 | 2/1932 | (FR) . |
| 363467 | 1/1974 | (SE) . |
| 458332 | 3/1989 | (SE) . |

* cited by examiner

*Primary Examiner*—Robert J. Oberleitner
*Assistant Examiner*—Thomas J. Williams
(74) *Attorney, Agent, or Firm*—Bachman & LaPointe, P.C.

(57) ABSTRACT

An adjustment device for an item of furniture comprises two relatively mutually movable parts of which the one is elongate, cylindrical and longitudinally displaceable in relation to the other. A helical spring is disposed with pretensioning about a split sleeve which grips the cylindrical portion. At least one end of the spring is disposed for cooperation with an abutment in communication with the second part. An operating device is connected to the spring for realizing, on actuation between the ends of the spring and about the center axis of the spring, a relative rotational movement which is counter-directed to the pretensioning.

7 Claims, 5 Drawing Sheets

ADJUSTMENT DEVICE

BACKGROUND OF THE INVENTION

The present invention relates to an adjustment device for an item of furniture and comprises two relatively mutually movable parts of which the one is elongate, cylindrical and longitudinally displaceable in relation to the other. The present invention also relates to the use of an adjustment device in an item of furniture such as a chair or a table.

Swedish Printed Application No. 458 332 describes an adjustment device which is intended for adjusting a chair so that its seat and back can be steplessly adjusted in relation to one another. The adjustment device includes an outer sleeve with slide bushings disposed at each end extending through a rod or a tube. Between the slide bushings, there is a clamping jaw or a sleeve which is urgable under the action of a screw against the rod for locking the rod in optional displacement position in relation to the outer sleeve. The construction according to this Swedish Printed Application functions satisfactorily, but is expensive to manufacture and difficult to remote control.

European Patent Application EP 0 A11 338 A1 discloses a similar adjustment device as described above wherein a helical spring is employed as a clamping device between the two relatively movable parts. While the device with the helical spring works well, there is a wear problem between the spring and the movable parts.

Accordingly, it is the principle object of the present invention to provide an adjustment device wherein the drawbacks inherent in the prior art devices described above are overcome.

It is a further object of the present invention to provide an adjustment device which is simple and economical to manufacture and easy to operate.

It is a still further object of the present invention to provide an adjustment device which affords reliable and dependable locking in any selected adjustment position and which possesses good mechanical strength and durability.

SUMMARY OF THE INVENTION

The foregoing objects and advantages are achieved by way of the present invention wherein an adjustment device for providing for relative movement between a first member and a second member wherein the first member is spaced from and surrounds in part the second member so as to define a gap therebetween, comprises a hollow split sleeve disposed in the gap and around the second member and a helical spring disposed about the sleeve between opposed ends of the sleeve for gripping the sleeve whereby the sleeve grips the second member when the spring is in a pretensioned position. A mechanism for actuating the spring for releasing the pretensioning position of the spring allows for relative movement between the first member and the second member.

BRIEF DESCRIPTION OF THE DRAWINGS

The present invention will now be described in greater detail hereinbelow, with particular reference to the accompanying drawings. In the accompanying drawings.

DETAILED DESCRIPTION

Figure 1:
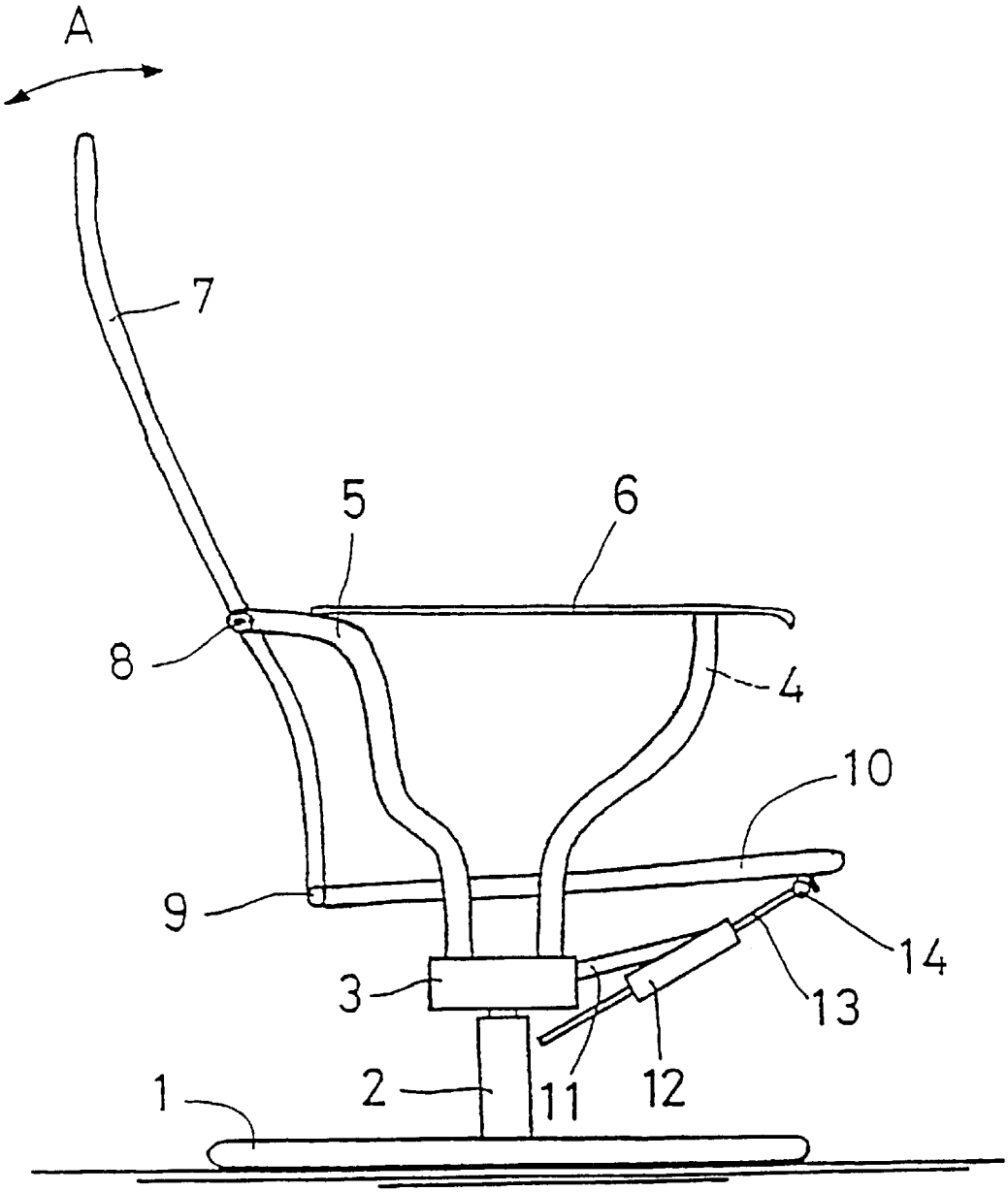
FIG. 1 shows an adjustable chair in the upright, sitting position and provided with the adjustment device according to the present invention.

The chair illustrated in FIG. 1 has a foot 1 which is centrally provided with a journalling portion 2 in which a carrier portion 3 is pivotally journalled about a vertical shaft. The carrier portion 3 carries a front yoke 4 which, with a lower portion, is secured in the carrier portion and then flares laterally so that it extends on both sides of the seat of the chair. A rear yoke 5 is designed in a corresponding manner and the rear and front yokes further carry the arm support 6 of the chair. The carrier portion 3, the two yokes 4 and 5 and the arm support 6 may be considered as the frame of the chair which, as was intimated above, is pivotal about a vertical shaft in the journalling portion 2.

The chair further includes a back support 7 which, by means of joints 8, is pivotally secured in the rear and upper ends of the rear yoke 5. Hereby, the back support 7 is pivotal as intimated by means of the arrow A.

Both the rear yoke 5 and the joints 8 are designed in such a manner as to realize a constant suspension of the back support 7, since the back support, as will be apparent below, will take up a large proportion of the loading which acts against the seat of the chair when the chair is occupied.

The back support 7 has, in its lower end, joints 9 by means of which the seat 10 of the chair is pivotally secured in the lower end of the back support 7.

For supporting and guiding the front end of the seat 10, the chair includes a carrier arm 11 secured in the carrier portion 3, the arm having a guide portion 12. In the guide portion, there is accommodated an adjustment rod 13 which is displaceable therein in its longitudinal direction and which is T-shaped in its front or upper end and which further, by means of joints 14, is secured in a front central portion of the seat 10 of the chair. The joints 14 are located in spaced apart relationship from one another in a direction which is at right angles to the plane of the drawing in FIGS. 1 and 2, whereby the rod 13 can only be pivoted in a vertical plane which is parallel with the plane of the drawing. This implies a good rigidification of the chair, whereby the front end of the seat 10 is prevented from moving in the horizontal direction transversely of the lateral direction of the chair.

Figure 2:
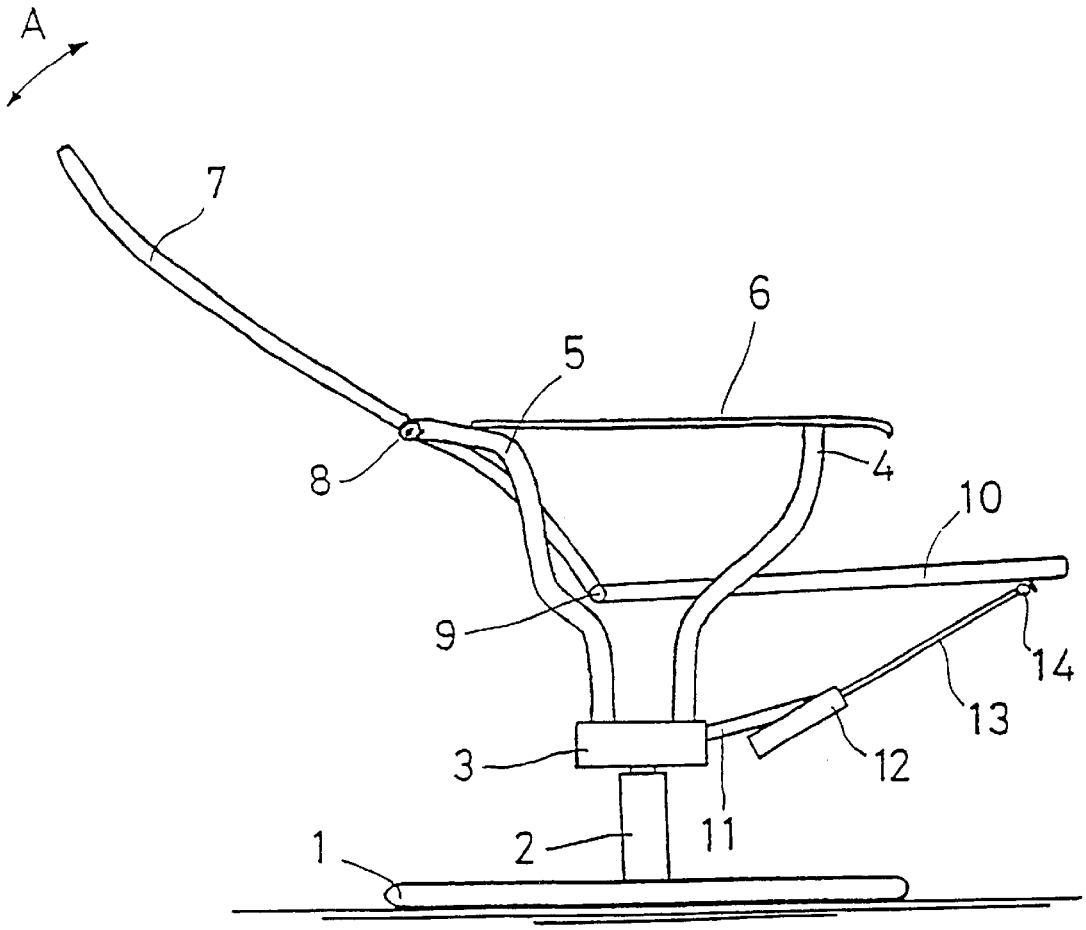
FIG. 2 shows the chair of FIG. 1 in a steeply reclining position.

FIG. 2 shows the chair in a reclining or collapsed position and it will be apparent from the figure that the rod 13 is displaced in a direction to the right and upwards in relation to that position it assumed in FIG. 1. Further, the joints 9 connecting the back support 7 and the seat 10 have been lifted as a result of the pivoting so that the rear portion of the seat 10 will hereby assume a higher vertical position than was the case in FIG. 1. In order also to impart to the front portion of the seat 10 a suitable vertical position on reclining or collapsing of the back support 7, the guide portion 12 is directed at an acute angle to a horizontal plane such that its end facing towards the front edge of the seat 10 is located at a higher level than its opposing end. The angle of inclination which the guide portion 12— and consequently also the adjustment rod 13— should have may be adjusted in such a manner that the chair is comfortable in both the raised state according to FIG. 1 and the reclining state according to FIG. 2.

Figure 3:
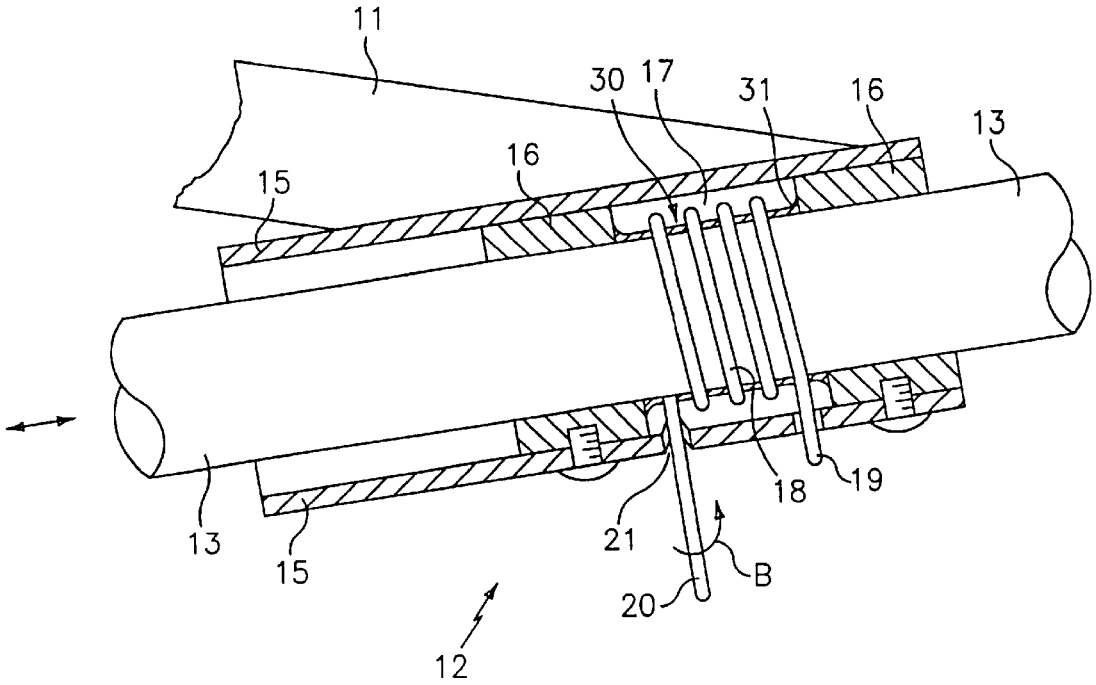
FIG. 3 is a longitudinal cross section through the adjustment device which is employed in the chair according to FIGS. 1 and 2.

FIG. 3 shows a longitudinal section through the adjustment device which includes the adjustment rod 13 and the guide portion 12 and which is employed in the chair according to FIGS. 1 and 2. It will be apparent from the figure that the guide portion 12 has an outer tubular sleeve 15 which has slide bushings 16 in spaced apart relationship to one another and consisting of suitable material of low coefficient of friction in relation to the adjustment rod 13. Such a material may, for example, be a plastic.

As will be apparent from the figure, the adjustment rod 13 extends right through both of the slide bushings 16 so that the adjustment rod is displaceable in its longitudinal direction through them. The slide bushings 16 are fixed in the outer tubular sleeve 15 in the axial direction by means of screws, pins, locking rings or other suitable means.

Figure 6:
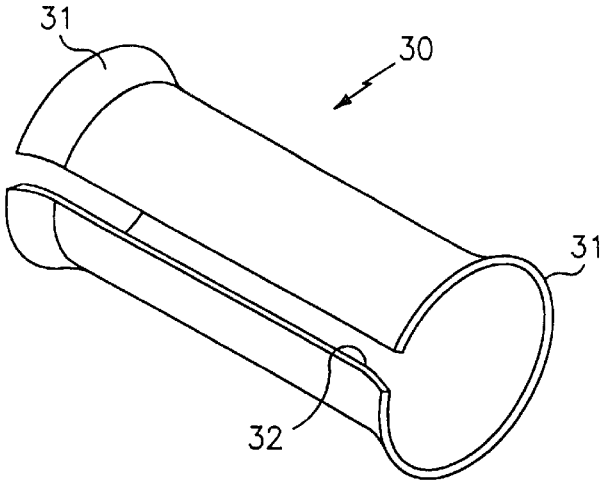
FIG. 6 is an enlarged perspective view of the split metal sleeve of-the present invention.

In the illustrated embodiment of FIGS. 3 and 6, the adjustment rod is cylindrical and solid, but could just as well be a cylindrical tube. In the space 17 which is formed between the slide bushings 16, there is disposed a split metal sleeve 30 around the cylindrical portion 13. A helical spring 18 is disposed around the split metal sleeve 30. The split metal sleeve 30 has a pair of opposed abutments 31 between which the helical spring is located. The abutments may be in the form of collars, upturned ends or any other structure which would keep the spring located in place on the sleeve 30. The spaced abutments 31 assure that the sleeve 30 and the spring 18 stay connected during adjustment of the rod 13. The sleeve is preferably made of hardened steel so as not to be abraided by the helical spring 18. However, other suitable metals and hard plastics may be used as long as the material is not abraided by the spring 18. The sleeve, in the preferred embodiment, is relatively thin and, preferably, has a thickness of between about 0.2 to 0.3 mm. The sleeve has a longitudinal slit substantially along central axis A which allows the sleeve to decrease in diameter and grip rod 13 when the sleeve is squeezed from the outside by the helical spring 18. Alternatively, the slit may be diagonal to the longitudinal axis A and of any suitable shape. The width of the slit 32 is such that when maximum spring force is applied to the metal sleeve 30 for gripping the rod 13, there is still a gap left. The spring 18 is pretensioned in order to nip about the split metal sleeve 30 for gripping the cylindrical portion, i.e. the adjustment rod 13, when the spring 18 is not actuated. At least one end of the spring is disposed for cooperation with an abutment so that an axial displacement of the spring is prevented when this is released from the split metal sleeve 30. In the embodiment illustrated in FIG. 3, there are two abutments, one on either side of the sleeve 30 and both of these abutments consist of the two slide bushings 16.

The number of coils in the spring may lie in the order of magnitude of between 3 and 15 and must be determined empirically. The same situation applies to the wire gauge which the spring 18 is to have.

In FIG. 3 the spring 18 is shown as somewhat loosely wound. This implies that a relatively gentle locking function may be expected, other words there will not be a "dead stop" when the spring 18 enters into engagement about the split metal sleeve 30. The spirit and scope of the present invention naturally also encompasses an embodiment in which the coils of the spring 18 lie closely adjacent one another such that the spring is thereby tightly wound. Irrespective of how the spring is wound, it should be disposed relatively free of play in the axial direction in relation to the abutments 31. Correspondingly, the sleeve 30 should be disposed relatively free of play in the axial direction relative to central axis A by the abutments 16 against which it comes into abutment on locking and the cylindrical portion 13 is subjected to an axial force.

When the spring is opened, its opposing ends 19 and 20 are turned against the pretensioning approximately about the center axis of the spring. In FIG. 3, this is realized in that the one end portion 19 of the spring is fixed either in an aperture in the outer tubular sleeve 15 or in a suitable bore in the adjacent slide bushing 16. The opposing end 20 of the spring is pivotal in accordance with the arrow B about the center axis of the spring. This pivoting action of the end portion 20 of the spring is permitted in that the spring extends out through a surrounding aperture 21 in the outer sleeve 15.

For operating the spring, its projecting end portion 20 may directly be provided with an operating handle, but may also be connected via a remote control mechanism comprising wires, lines, linkage arm systems, lever systems or the like to an operating handle a distance from the spring.

Figure 4:
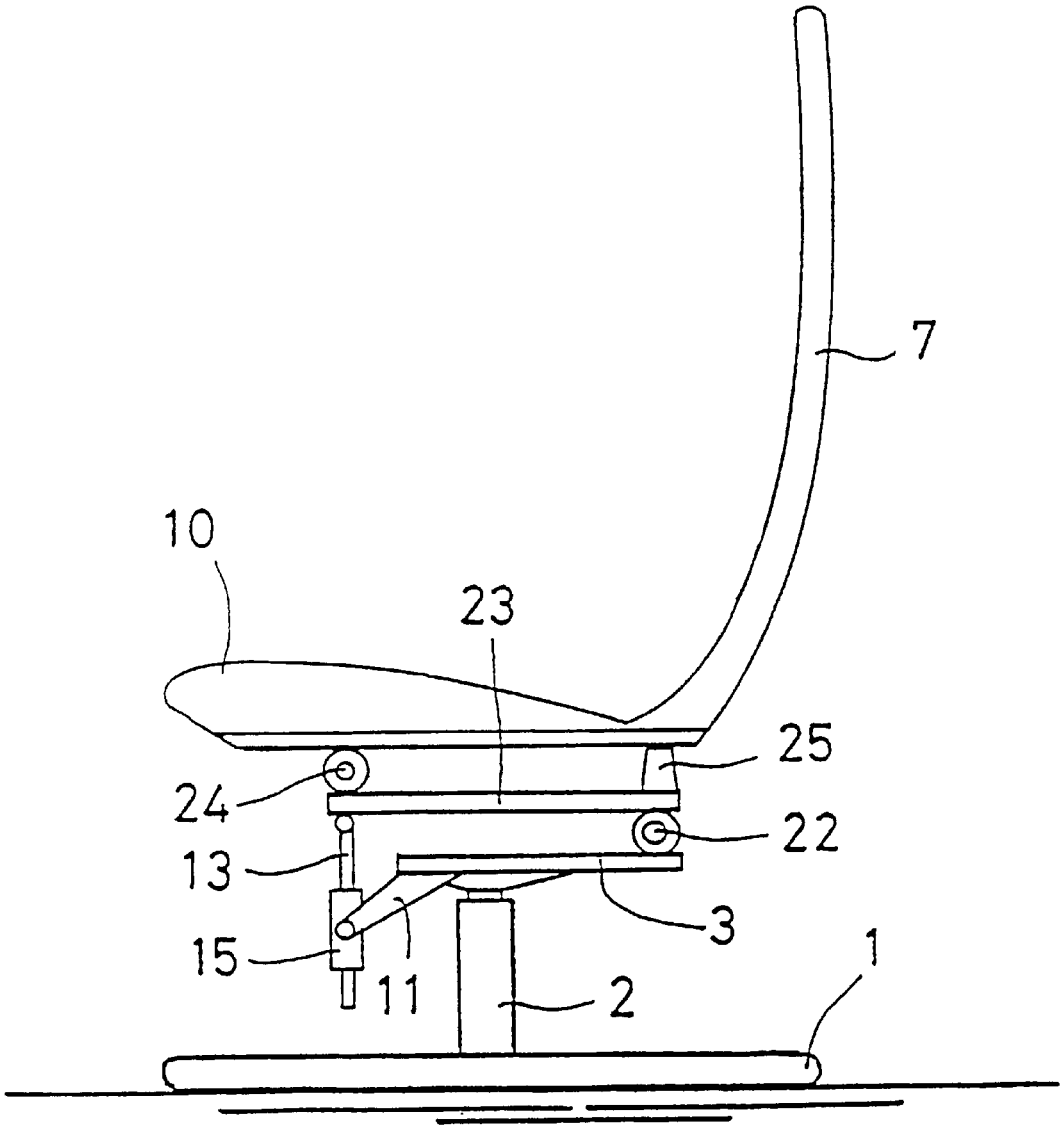
FIG. 4 shows an alternative embodiment of an adjustable chair.

FIG. 4 shows a chair of modified design in relation to that shown in FIGS. 1 and 2. The components in both of the chairs which are the same or have a close counterpart in each other have been given the same reference numerals and their description will not be repeated here.

In analogy with the chair according to FIGS. 1 and 2, in the embodiment according to FIG. 4 the carrier portion 3 is suitable rotary in relation to the foot 1 about a vertical shaft so that, thereby, the entire chair may be rotated. At a rear section of the carrier portion 3, there is provided a joint 22 whose pivot axis is substantially horizontal and transversely directed in relation to the longitudinal direction of the chair. The joint 22 is further connected to an intermediate portion 23 which has a joint 24 whose pivot axis is substantially parallel with the pivot axis of the joint 22. The joint 24 is connected to the seat 10 of the chair so that the seat of the chair is pivotal about the pivot axis of the joint 24 in relation to the intermediate portion 23. A distance from the joint 24, there is provided a spring element between the intermediate portion and the seat 10 so that the seat 10 may thereby be tilted about the pivot axis of the joint 24. The spring element 25 may, for example, be a rubber buffer, but may also be designed in any other optional manner and can, for example, comprise a torsion spring, a spiral spring, a gas spring or other suitable spring element. Between the seat 10 of the chair and the carrier portion 3, there is provided, in functional respects, an adjustment device of the type described with reference to FIG. 3. The adjustment device is here placed a distance from the joint 22. It is hereby possible to carry out an adjustment of the inclining position of the seat 10 in relation to the horizontal plane and, about this adjustment position, also tilt the seat about the pivot axis of the joint 24.

In the embodiment illustrated in FIG. 4, the carrier portion 3 has, on its side facing away from the joint 22, a carrier arm 11 in which the adjustment device is pivotally secured about an axis which is substantially horizontal and transversely directed in relation to the longitudinal direction of the chair. In the figure, the outer tubular sleeve 15 of the adjustment rod 13, i.e. the cylindrical portion which, interiorly in the adjustment device, cooperates with the spring. The upper end of the adjustment rod 13 is pivotally secured in the intermediate portion 23 and is pivotal about an axis which is substantially parallel with the pivot axes of the joints 22 and 24.

The embodiment according to FIG. 4 may be modified such that the intermediate portion 23 is dispensed with and instead the adjustment rod 13 is pivotally secured direct in the seat 10. In this embodiment, the joint 22 is also dispensed with, such that the spring element 25 acts between the seat 10 and the carrier portion 3.

Figure 5:
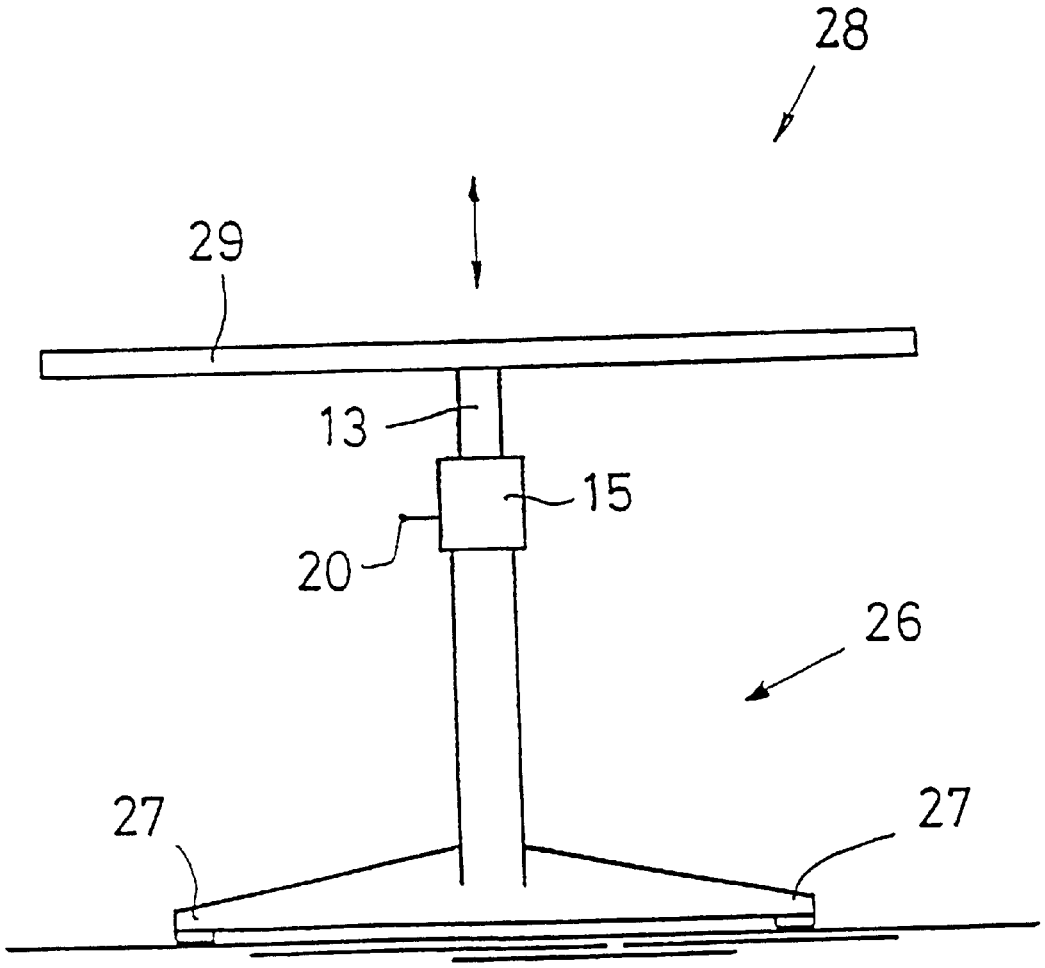
FIG. 5 shows a raisable and lowerable table.

FIG. 5 shows a vertically adjustable table in which the adjustable setting may be locked steplessly in any optional vertical position by means of an adjustment device of the above-described type.

The table according to FIG. 5 has an undercarriage 26 with the feet 27 resting on a substrate. The table is further provided with a table top 28 with a table panel 29. The table top 28 is raisable and lowerable in relation to the undercarriage 26 by means of a telescoping mechanism which, for locking in the optional vertical adjustment position, includes the above-described adjustment device.

In this embodiment, the cylindrical portion 13 of the adjustment device is fixedly connected to the table panel 29, while the outer tubular sleeve 15 is connected to the undercarriage 26. In the figure, the end portion 20 of the spring is also intimated.

The construction of the table may be modified on such a manner that the cylindrical portion 13 is connected to the undercarriage 26, while the outer tubular sleeve 15 is connected to the table top 28. Granted, with such a construction, adjustment possibilities are limited in the vertical direction, but at the same time the advantage is gained that it is easier to transfer the movement required for opening and closing the adjustment device to handles located readily accessibly in connection with the edge of the table panel 29.

Yet a further field of application for the adjustment device according to the invention might be a table in which the table panel is, along its one edge, pivotally secured in the undercarriage so that the inclination of the table panel in relation to the horizontal plane may thereby be altered. The adjustment device is, in such instance, placed between the table panel and the undercarriage with both the cylindrical portion and the outer tubular sleeve pivotally secured in the table panel and undercarriage, respectively, or vice versa.

The present invention may be modified further without departing from the spirit and scope of the appended claims.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An adjustment device for an article of furniture having a first and a second relative moving part wherein the first part is spaced from and surrounds at least a portion of the second part about a central axis A to define a gap between the first part and the second part, the improvement which comprises:

a hollow sleeve disposed in said gap and around said second part, said hollow sleeve having opposed ends and a slit extending between said opposed ends;

a helical spring means disposed with pretensioning about said sleeve between said opposed ends for gripping said sleeve whereby said sleeve grips said second part, said spring having a first end and a second end; and actuation means associated with at least one of said first end and second end of the spring for releasing the pretensionig about said sleeve for moving said first part and second part relative to each other, wherein said hollow sleeve has formed thereon proximate to said opposed ends abutment means, said helical spring is disposed between said abutment means holding said spring in place on said hollow sleeve.

2. An adjustment device according to claim 1 wherein said slit is substantially parallel to said central axis A.

3. An adjustment device according to claim 1 wherein a pair of spaced apart abutments are provided in said gap on either side of said hollow sleeve and are fixed to said first part for substantially holding said hollow sleeve in place axially.

4. An adjustment device according to claim 1 wherein said first part is provided with a pair of apertures for receiving said first end and said second end of said helical spring wherein said first end and said second end pass through said apertures, wherein said actuation means is associated with both said first end and said second end.

5. An adjustment device according to claim 1 wherein said abutment means are collars.

6. An adjustment device according to claim 1 wherein said abutment means are upturned ends.

7. An adjustment device according to claim 1 wherein said slit is substantially diagonal to said central axis A.

* * * * *